United States Patent [19]

Babicz

[11] Patent Number: 5,057,051

[45] Date of Patent: Oct. 15, 1991

[54] NIGHT LIGHT TOY APPARATUS

[76] Inventor: Amy H. Babicz, 130 Lincoln Pl., Liberty, N.Y. 12754

[21] Appl. No.: 619,391

[22] Filed: Nov. 29, 1990

[51] Int. Cl.[5] ..... A63H 33/00; A63H 33/26; A63H 33/00; A63H 3/52

[52] U.S. Cl. ..... 446/227; 446/485; 446/489; 446/408; 446/901

[58] Field of Search ..... 446/227, 228, 485, 484, 446/236, 242, 243, 332, 397, 408, 489, 901; 362/801, 806, 808

[56] References Cited

U.S. PATENT DOCUMENTS

| | | | |
|---|---|---|---|
| 2,370,601 | 2/1945 | Wimppheimer et al. | 446/485 X |
| 2,807,117 | 9/1957 | Davies | 446/117 X |
| 2,813,373 | 11/1957 | Heller | 446/408 X |
| 2,886,919 | 5/1959 | Glass et al. | 446/485 X |
| 3,636,654 | 1/1972 | Workman | 446/408 |
| 4,361,981 | 12/1982 | Reiling et al. | 446/485 X |
| 4,508,511 | 4/1985 | McQueen | 446/485 X |
| 4,549,250 | 10/1985 | Spector | 362/806 X |
| 4,594,072 | 6/1986 | Cowell | 446/227 |
| 4,722,713 | 2/1988 | Williams et al. | 446/227 |
| 4,968,279 | 11/1990 | Smith | 446/227 X |

FOREIGN PATENT DOCUMENTS

| | | | |
|---|---|---|---|
| 0149296 | 7/1985 | European Pat. Off. | 446/227 |
| 2199256 | 6/1988 | United Kingdom | 446/485 |
| 2221626 | 2/1990 | United Kingdom | 446/485 |

*Primary Examiner*—David N. Muir
*Attorney, Agent, or Firm*—Leon Gilden

[57] ABSTRACT

An apparatus including a housing for mounting, including plural pairs of securement straps, with a forward face of the housing including a plurality of devices for use by an infant to provide entertainment and enhance manual dexterity of the infant, as well as the provision of a night light. The organization includes a manually displaceable and rotatable cylinder to effect selective illumination of the various colored panels within the cylinder. An audible producing pull toy component, a manually displaceable slide toy arrangement, and an audible bell member to accommodate and entertain various sensory portions of an infant are included.

1 Claim, 4 Drawing Sheets

NIGHT LIGHT TOY APPARATUS

BACKGROUND OF THE INVENTION

1. Field of the Invention

The field of invention relates to night light arrangements, and more particularly pertains to a new and improved night light toy apparatus wherein the same utilizes an array of sensory gratifying arrangements mounted in association with a night light organization to provide entertainment and sensor education of an infant.

2. Description of the Prior Art

Various night light apparatus has been set forth in the prior art. The instant organization attempts to overcome deficiencies of the prior art by setting forth an organization that provides an entertainment and exercise of various manual skills of an infant or child. Examples of the prior art include U.S. Pat. No. 4,714,984 to Spector wherein a night light assembly directs light through a plate member that exudes an aromatic odor.

U.S. Pat. No. 4,549,250 to Spector sets forth a night light assembly providing a further type of aromatic odor in use, as well as U.S. Pat. No. 4,544,592 to the same inventor utilizing an aromatic generating capsule for essential use in a night light generating arrangement.

U.S. Pat. No. 4,816,973 to Atalla, et al. sets forth a further example of a night light in cooperation with a further function as an aromatic dispensing arrangement.

U.S. Pat. No. 4,878,162 to Wu sets forth a night light lamp shade arrangement for surroundingly mounting to a night light type bulb.

As such, it may be appreciated that there continues to be a need for a new and improved night light toy apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of night light organizations now present in the prior art, the present invention provides a night light toy apparatus wherein the same provides for utilization of the organization within conditions of limited light by an infant or child to enhance the child's manual, audible, and visual sensory senses. As such, the general purpose of the present invention, which will be described subsequently in greater detail, is to provide a new and improved night light toy apparatus which has all the advantages of the prior art night light apparatus and none of the disadvantages.

To attain this, the present invention provides an apparatus including a housing for mounting, including plural pairs of securement straps, with a forward face of the housing including a plurality of devices for use by an infant to provide entertainment and enhance manual dexterity of the infant, as well as the provision of a night light. The organization includes a manually displaceable and rotatable cylinder to effect selective illumination of the various colored panels within the cylinder. An audible producing pull toy component, a manually displaceable slide toy arrangement, and an audible bell member to accommodate and entertain various sensory portions of an infant are included.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved night light toy apparatus which has all the advantages of the prior art night light apparatus and none of the disadvantages.

It is another object of the present invention to provide a new and improved night light toy apparatus which may be easily and efficiently manufactured and marketed.

It is a further object of the present invention to provide a new and improved night light toy apparatus which is of a durable and reliable construction.

An even further object of the present invention is to provide a new and improved night light toy apparatus which is susceptible of a low cost of manufacture with regard to both materials and labor, and which accordingly is then susceptible of low prices of sale to the consuming public, thereby making such night light toy apparatus economically available to the buying public.

Still yet another object of the present invention is to provide a new and improved night light toy apparatus which provides in the apparatuses and methods of the prior art some of the advantages thereof, while simultaneously overcoming some of the disadvantages normally associated therewith.

Still another object of the present invention is to provide a new and improved night light toy apparatus wherein the same is arranged for convenience of mounting to direct a child's attention and entertainment of the manual, visual, and audible sensory senses of a child or infant.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
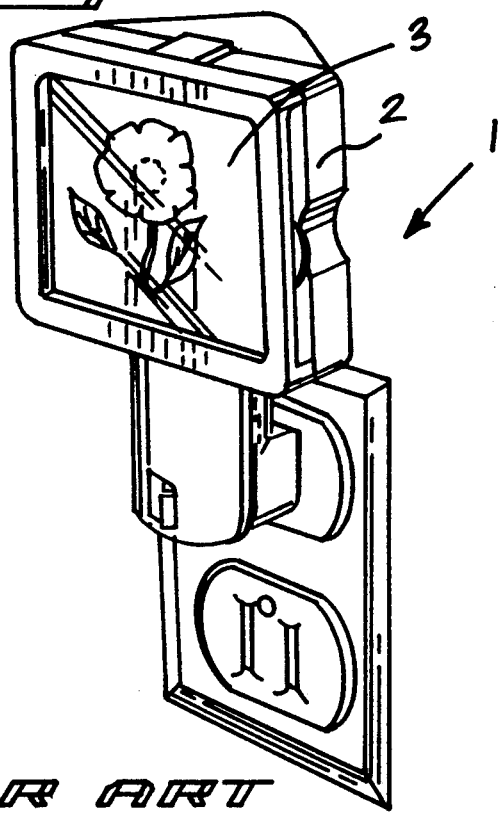
FIG. 1 is an isometric illustration of a prior art night light apparatus.

With reference now to the drawings, and in particular to FIGS. 1 to 9 thereof, a new and improved night light toy apparatus embodying the principles and concepts of the present invention and generally designated by the reference numeral 10 will be described.

FIG. 1 illustrates a prior art night light structure 1, wherein a night light housing 2 mounts a translucent member 3 that emits an aromatic odor during illumination as set forth in U.S. Pat. No. 4,714,984.

More specifically, the night light toy apparatus 10 of the instant invention essentially comprises a housing 11, including a forward wall 12, a rear wall 13, and a top wall 14, as well as side walls and a bottom wall to define the housing 11 as an enclosure. A first strap pair 15 and a second strap pair 17 are mounted to the top wall, with the individual straps of each strap pair mounted in confronting relationship at an interface between the top wall and the forward and rear walls, wherein the individual straps of the first strap pair 15 and the individual straps of the second strap pair 17 are in spaced relationship to permit surrounding securement of a bar and the like such as utilized in a crib structure, or the organization may be positioned in a free-standing arrangement. The first strap pair 15 includes cooperating and mating first hook and loop fastener surfaces 16 on opposed straps of the first strap pair, with the second strap pair 17 utilizing cooperating and abating second hook and loop fastener surfaces 18 for a mating relationship of the straps of the second strap pair. A rear wall 13 includes a switch member 19 that is cooperative with at least one battery member 21 mounted within a battery compartment defined by an overlying and removable battery plate 20 to effect selective illumination of the various components of the organization, to be described in more detail below.

Figure 2:
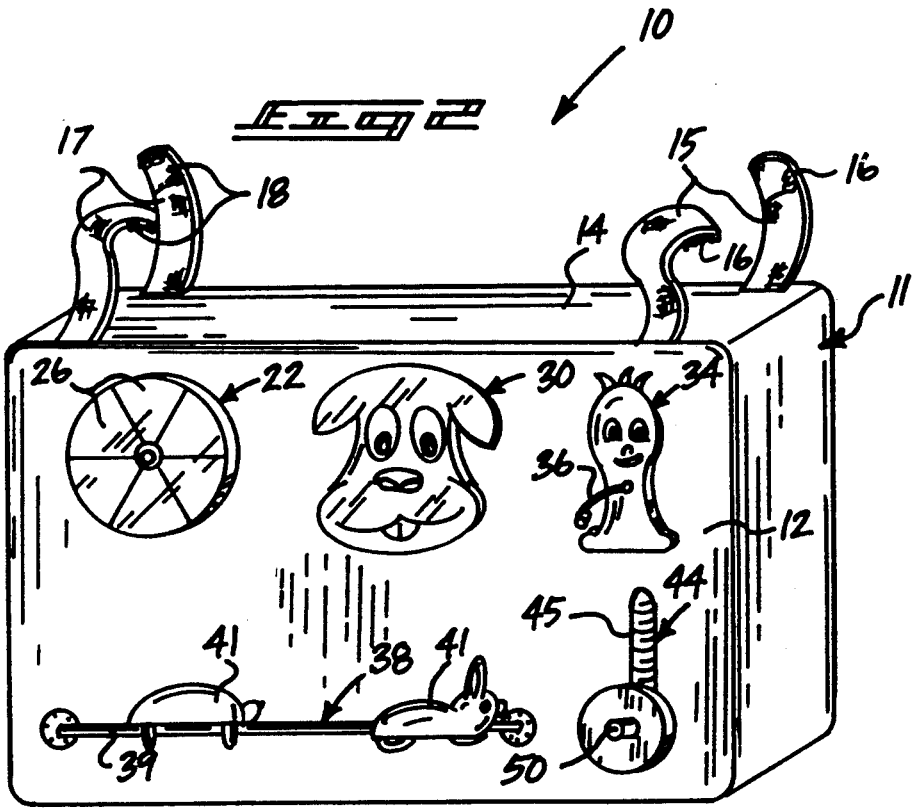
PRIOR ART FIG 2
FIG. 2 is an isometric illustration of the instant invention.
Figure 3:
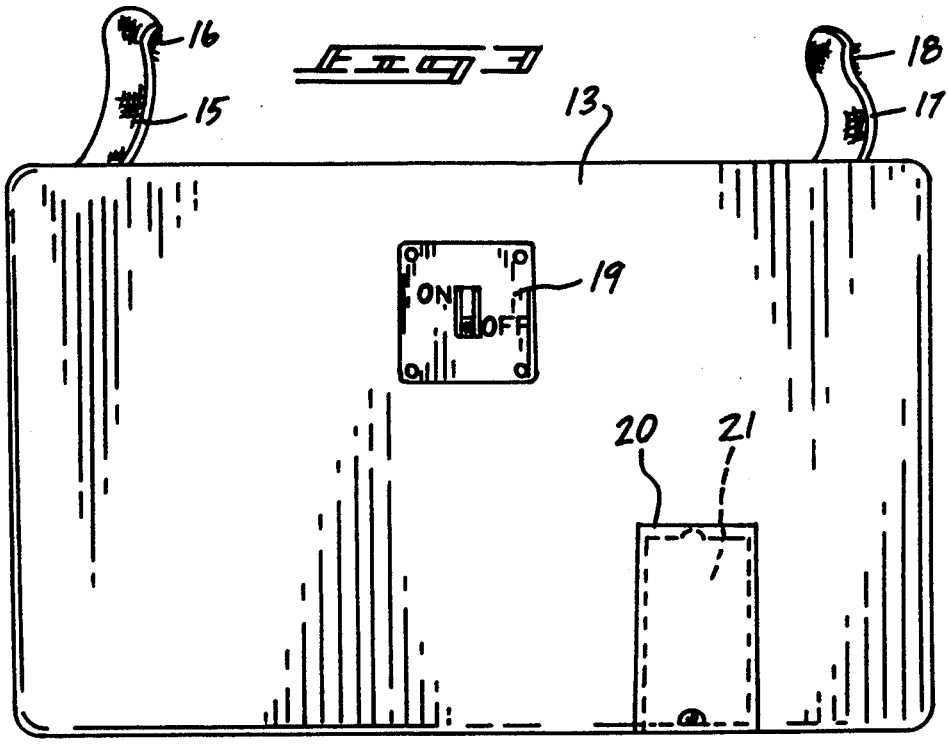
FIG. 3 is an orthographic rear view, taken in illustration, of the instant invention.
Figure 4:
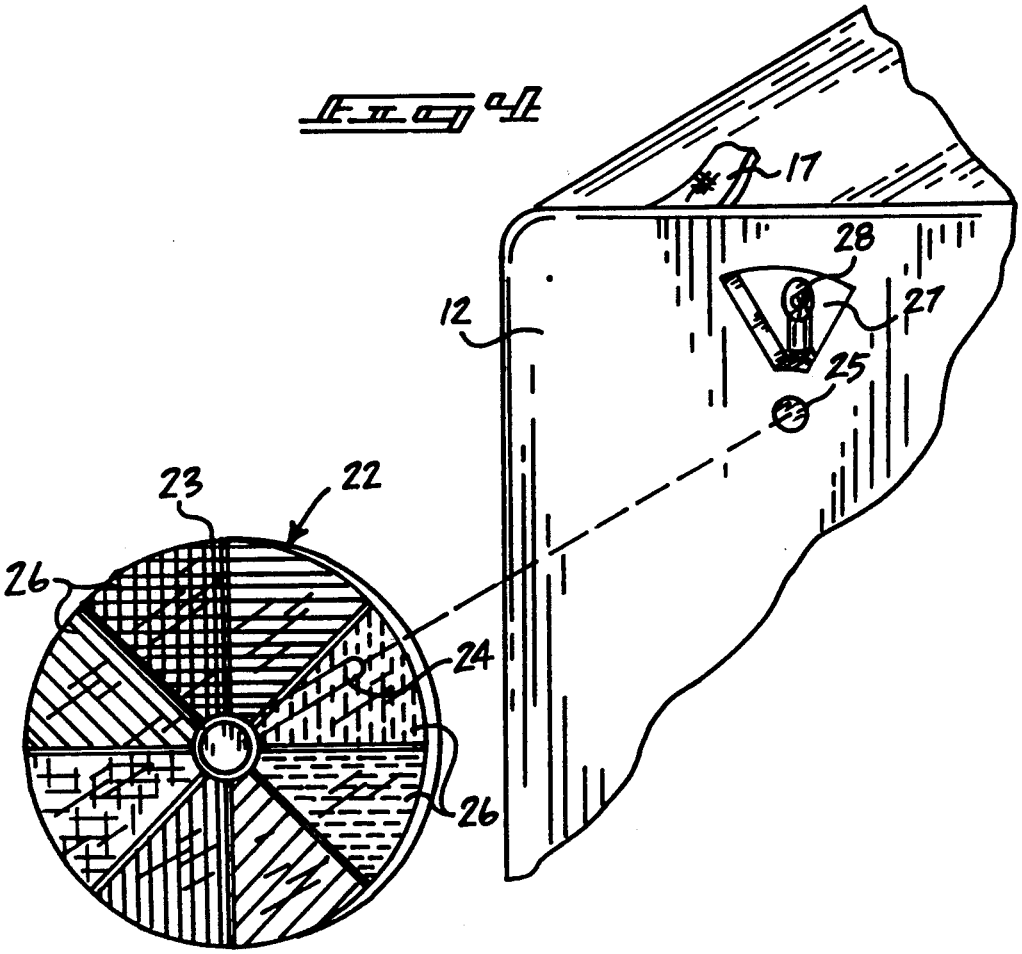
FIG. 4 is an isometric illustration of the spin assembly utilized by the instant invention.

FIGS. 2 and 4 illustrate the spin assembly 22 that is defined by a translucent cylindrical disk 23 comprised of a plurality of contrastingly colored sectors 26 defined by a predetermined configuration in a radial array about the cylindrical disk 23. An axle 24 is mounted orthogonally and coaxially to the cylindrical disk and is rotatably mounted to the cylindrical disk and is rotatably mounted within a front wall axle bore 25. A first forward wall opening 27 is defined by an equal predetermined configuration as that of the individual sectors 26 and is coaxially aligned with the cylindrical disks 23 and permit selective alignment of the opening 27 with one or more of the sectors 26 during rotation of the cylindrical disk 23 in use. A first illumination bulb 28 is mounted within the first opening 27 and is selectively illuminated through the switch 19 and the battery 21 for illumination in a conventional series circuit available to one of ordinary skill in the art.

Figure 5:
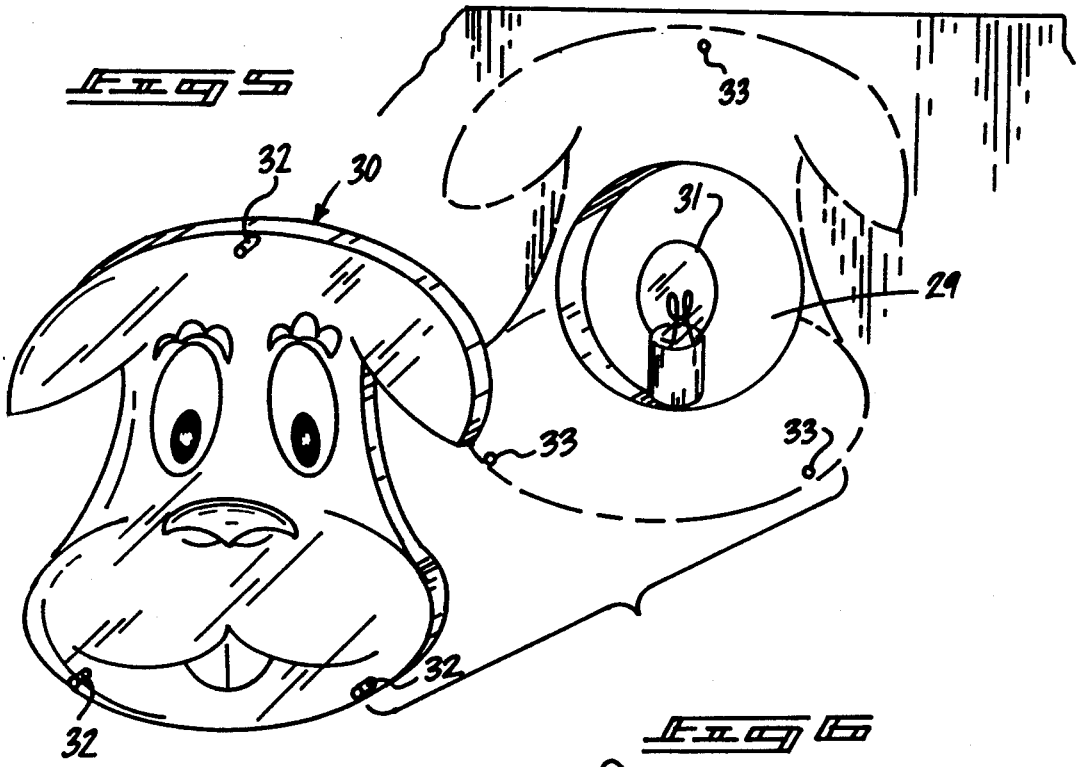
FIG. 5 is an isometric illustration of the night light component of the instant invention.

FIG. 5 illustrates the use of the translucent fixed night light member 30 that overlies a second forward wall opening 29 that in turn mounts a second illumination bulb 31 simultaneously illuminated with the first illumination bulb 28. The translucent light member 31 includes a plurality of cylindrical positioning pegs 32 orthogonally mounted to a rear surface of the light member 30, with each peg receivable within a cooperating cylindrical positioning bore 33 that are spaced about the second opening 29. The peg and bore structure 32, 33 permits selective replacement of the translucent light member 30 to provide a variety of such configuration as desired by an individual for amusement and entertainment of the child.

Figure 6:
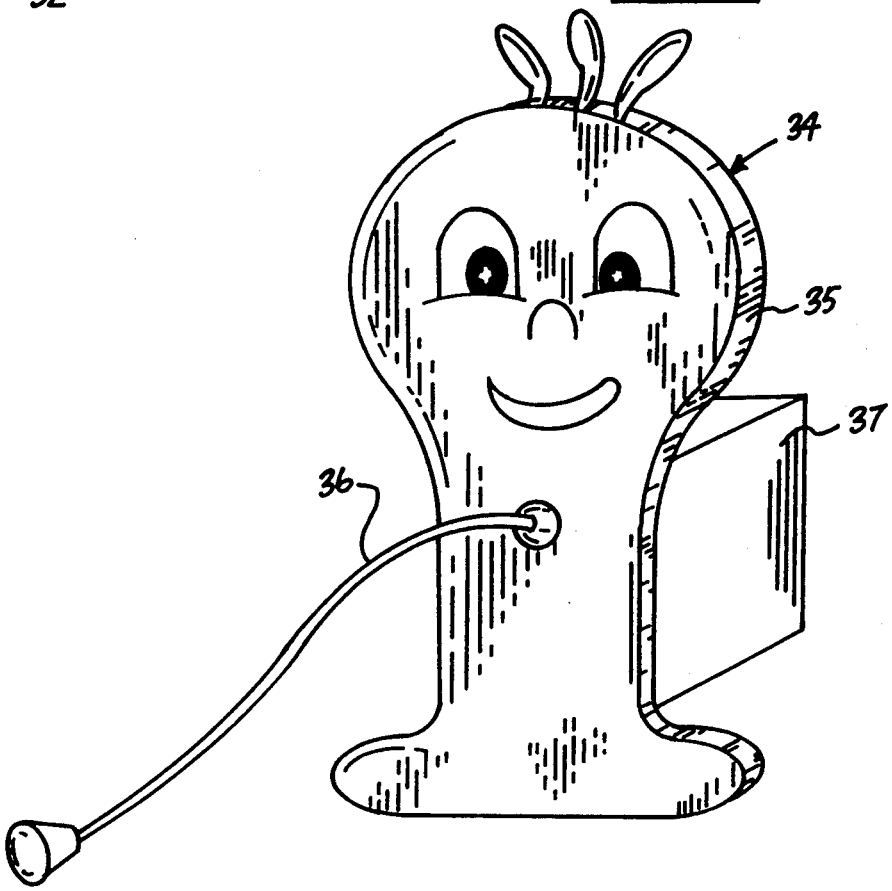
FIG. 6 is an isometric illustration of the audible reproduction assembly of the instant invention.

FIG. 6 sets forth the use of an audible reproduction assembly 34 that includes a mounting plate 35 fixedly mounted to the forward walls 12, with an audible reproduction housing 37 mounted interiorly of the housing 11 and operatively associated with the mounting plate 35 by a pull cord 36 directed therethrough. Extension of the pull cord and manipulation thereof by a child effects actuation of an audible reproduction device contained within the audible reproduction housing 37.

Figure 7:
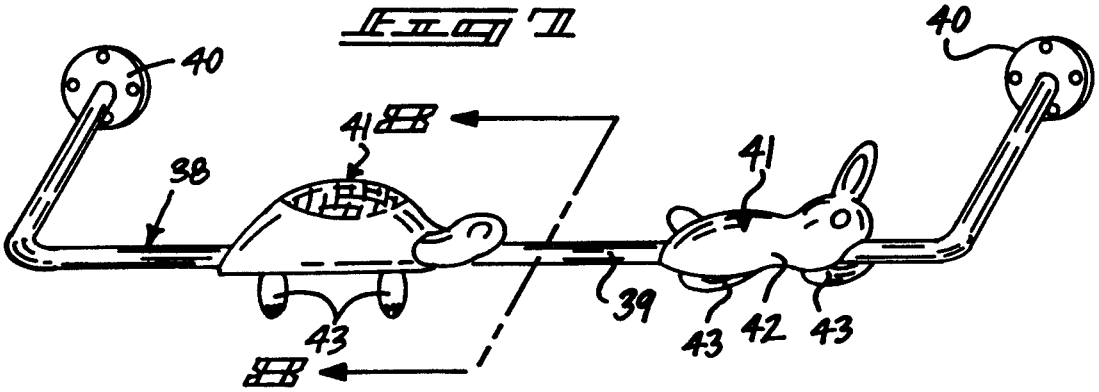
FIG. 7 is an isometric illustration of the manually manipulatable slide assembly of the instant invention.
Figure 8:
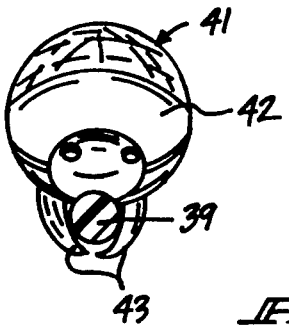
FIG. 8 is an orthographic view, taken along the lines 8—8 of FIG. 7 in the direction indicated by the arrows.

FIG. 7 sets forth the toy slide assembly 38 that includes a "U" shaped bar, with a mounting plate 40 orthogonally mounted at each free terminal end of each leg of the "U" shaped bar. The bar 39 slidably mounts a plurality of slide toy members 41 thereon. Each slide toy member 41 includes a body portion and a plurality of downwardly extending leg pairs in surrounding relationship relative to the bar 39 to permit sliding of the toy members 41 about the bar.

Figure 9:
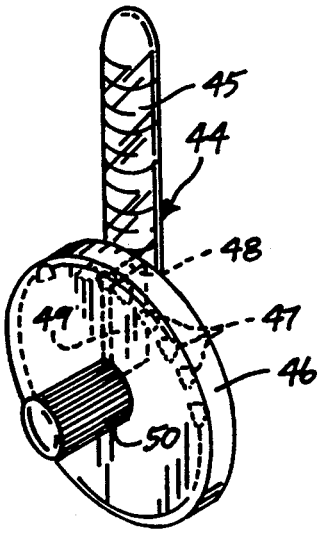
FIG. 9 is an isometric illustration of the bell assembly of the instant invention.

FIG. 9 illustrates in great detail the bell assembly 44, including a thermometer 45 mounted thereto to provide temperature assessment for an adult relative to comfort of a child contained within the same environment as the apparatus 10. The bell assembly 44 includes a cylindrical bell housing 46, with a series of radially aligned and equally spaced tubular bell members 47 mounted about an inner circumferential periphery of the housing 46, wherein a clapper rod 48 is radially mounted at an outer terminal end of a clapper rod flexible support plate 49, whereupon the support plate 49 is of a memory retentent material, whereupon rotation of the dial 50 effects engagement of the clapper rod 40 with the tubular bell portions to effect audible actuation of the bell assembly 44. It is understood that alternatively a push type bell arrangement may be utilized if so desired of a like cylindrical configuration.

As to the manner of usage and operation of the instant invention, the same should be apparent from the above disclosure to provide manual exercise and improve manual gratification and dexterity of a child or infant utilizing the organization, wherein the organization may be utilized in conditions of limited light for the amusement of a child, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A night light toy apparatus comprising, a housing, the housing including a forward wall and a rear wall, with a top wall mounted between the forward wall and the rear wall, and the top wall including a first and second strap pair, wherein the first and second strap pair are arranged for securement of the housing to a support, and the forward wall including an illuminated spin assembly arranged for rotation relative to the forward wall, and a translucent night light member mounted to the forward wall, and an audible reproduction assembly mounted on the forward wall, and a slide assembly mounted to the forward wall, and a bell assembly mounted to the forward wall, and wherein the spin assembly includes a translucent cylindrical disk, the translucent cylindrical disk includes a plurality of contrasting colored sectors, each sector defined by a predetermined configuration, and the disk including an axle orthogonally and integrally mounted to the disk sitting rearwardly thereof, and the forward wall including an axle bore, and the axle bore rotatably mounted within the axle bore, and a first forward opening mounted within the forward wall, the first opening defined by a configuration equal to the predetermined configuration and coaxially aligned relative to the cylindrical disk to permit selective positioning of at least one of the sectors overlying the first opening, and an illumination bulb mounted within the first opening, and a switch means mounted to the housing on the rear wall, and battery means operative through the switch to effect selective illumination of the illumination bulb, and wherein the forward wall includes a second forward wall opening, the second forward wall opening including a second illumination bulb mounted therewithin, wherein the second illumination bulb is selectively illuminated in cooperation with the switch and the battery means, and the night light member formed of a translucent material and includes a plurality of cylindrical pegs, and the forward wall includes a plurality of cylindrical positioning bores, wherein the pegs are aligned with the cylindrical bores mounting the night light member to the forward wall, and wherein the audible reduction assembly includes a mounting plate, with the mounting plate fixedly mounted to the forward wall and an audible reproduction means mounted within the housing to effect audible reproduction, wherein the audible reproduction means includes a pull cord mounted in cooperation to the mounting plate in cooperation with the audible reproduction means for effecting an audible reproduction upon pulling of the pull cord, and wherein the slide assembly includes a "U" shaped bar, wherein the "U" shaped bar includes a mounting plate fixedly and orthogonally mounted to each free end of the "U" shaped bar, wherein each mounting plate is mounted to the forward wall, and a plurality of body portions mounted to the bar, wherein the body portions each include a plurality of downwardly extending leg pairs, with the leg pairs surroundingly encompassing the "U" shaped bar to slidably mount each body portion to the "U" shaped bar, and wherein the bell assembly includes a cylindrical bell housing, the cylindrical bell housing includes a cylindrical cavity and wherein a plurality of radially aligned and equally spaced tubular bell members are mounted within the bell housing circumferentially about the periphery of the bell housing interiorly thereof, and a dial coaxially mounted to the cylindrical bell housing, and the dial including an elongate flexible support plate formed of memory retentent material, with a clapper rod mounted at a free terminal end of the support plate, wherein the clapper rod is rotatably within the bell housing and cooperative with the tubular bell members to effect audible actuation of the tubular bell members upon rotation of the dial.

* * * * *